United States Patent [19]

Numata et al.

[11] 4,342,018

[45] Jul. 27, 1982

[54] MAGNET CONTROL DEVICE FOR CAMERAS

[75] Inventors: Saburo Numata, Urawa; Fumio Kobayashi, Omiya, both of Japan

[73] Assignee: Fuji Photo Optical Co., Inc., Saitama, Japan

[21] Appl. No.: 168,677

[22] Filed: Jul. 11, 1980

[30] Foreign Application Priority Data

Jul. 12, 1979 [JP] Japan ..... 54-88437

[51] Int. Cl.[3] ..... H01F 7/08

[52] U.S. Cl. ..... 335/270; 335/276

[58] Field of Search ..... 335/270, 276, 279, 281

[56] References Cited

U.S. PATENT DOCUMENTS 3,736,540 5/1973 Westphal ..... 335/279

4,172,241 10/1979 Bosch et al. ..... 335/279

*Primary Examiner*—George Harris

*Attorney, Agent, or Firm*—Eyre, Mann, Lucas & Just

[57] ABSTRACT

In a camera, a magnetic control device for controlling a shutter release mechanism or the like includes an electromagnet and a member to be attracted by the electromagnetic. The attracted member is mounted on an axle secured to a control lever. Between the axle and the attracted member, a resilient material is provided for allowing tilting of the attracted member around the axle so that the attracted member can be put into perfect face contact with the attracting face of the electromagnet even if the attracted face of the attracted member is at first not in parallel to the attracting face of the electromagnet.

4 Claims, 5 Drawing Figures

MAGNET CONTROL DEVICE FOR CAMERAS

BACKGROUND OF THE INVENTION

1. Field of the Invention

This invention relates to a magnet control device for use in a camera, and more particularly to an improvement in a magnet control device for controlling the start of an operation of a drive mechanism in a photographic camera.

2. Description of the Prior Art

In the photographic camera, it has been known to control a drive mechanism by use of a magnet. For instance, after driving energy has been charged in a drive mechanism, the operation of the drive mechanism is prevented until the operation should be started by use of a holding means utilizing a magnet. In a shutter drive mechanism, for example, an electromagnet is used for holding a driving member for a desired period with very fine accuracy of as short as 1/1000 second. The electric control is very advantageous in that the timing control can be conducted with very high accuracy.

Even when such an electromagnetic control means is used, however, the reliability of the drive mechanism is greatly influenced by the accuracy of the mechanical structure of the drive mechanism. The accuracy of the mechanical structure greatly depends upon the accurate face-to-face contact of the attracting face of the magnet and the attracted face of the attracted member pivotally mounte on a control lever associated with the control mechanism of the camera.

When the attracting face of the magnet and the attracted face of the member are not in perfect face contact with each other, the attracting force acting therebetween is markedly lowered and there is a possibility of malfunction of the mechanism. At worst, there is a possibility that the attracted member moves apart from the attracting face of the magnet before the magnet is demagnetized. Further, there are possibilities that the timing of separation of the attracted member from the attracting magnet is not accurately controlled.

The imperfect face-to-face contact between the magnet and the attracted member is caused generally by errors in mounting the various elements and members in the control mechanism. Particularly when those parts are assembled together, it is very difficult to assemble all those parts with perfect accuracy. There may be errors in the relative positions in the assembled mechanism, generally. Further, the adjustment of the various parts of the mechanism conducted after assembling is very delicate and necessitates a great skill.

Therefore, it is desired that those parts are automatically adjusted properly when those parts are assembled with insufficient adjustment.

SUMMARY OF THE INVENTION

The object of the present invention, therefore, is to provide a magnet control device for a camera in which the magnet control device itself is automatically properly adjusted after assembled in a camera.

This object of the present invention is accomplished by providing a resilient means between the attracted member and the control lever on which the attracted member is mounted so that the attracted member is brought into correct face contact with the attracting face of the magnet by the resilience of the resilient means.

By the provision of the resilient means between the lever and the attracted member, the position or orientation of the attracted member can be resiliently varied so as to follow a little inclination of the attracting face of the magnet and accordingly the attracted face can be brought into perfect face contact with the attracting face of the magnet.

DESCRIPTION OF THE PREFERRED EMBODIMENTS

Now the present invention will be described with reference to particular embodiments thereof referring to the accompanying drawings.

Though the following embodiments all employ an electromagnet, it should be noted that the electromagnet may be replaced by a combination of a permanent magnet and an electromagnetic coil.

Figure 1:
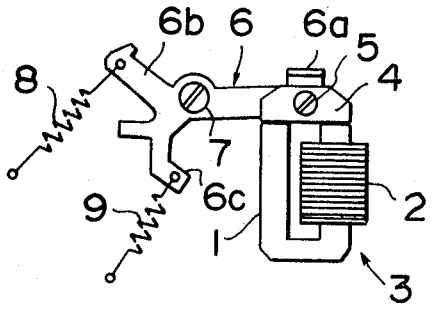
FIG. 1 is a front view showing an example of a magnet control mechanism to which the present invention is applicable.
Figure 2:
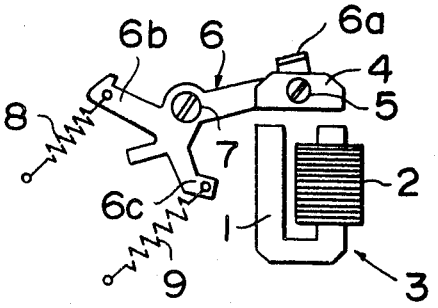
FIG. 2 is a front view similar to FIG. 1 showing another state of the magnet control mechanism.

Referring to FIGS. 1 and 2, an iron core 1 is provided with an electromagnetic coil 2 to constitute an electromagnet 3. An attracted member 4 made of iron or other ferromagnetic or magnetizable material is pivotally mounted on a control lever 6 by means of an axle 5. The control lever 6 is provided with a stopper portion **6*a* above the attracted member 4 to prevent the attracted member 4 from rotating freely. The control lever 6 is pivotally mounted on a pivot 7 and rotatable thereabout in the clockwise and counterclockwise directions. In the position shown in FIG. 1, the attracted member 4 is in face contact with the upper end face of the iron core 1**.

The control lever 6 is further provided with arms **6*b* and 6*c* which are connected with bias springs 8 and 9, respectively. By the bias spring 8, the control lever 6 is urged in the counterclockwise direction, and by the bias spring 9 the control lever 6 is urged in the clockwise direction. The tension force of the spring 8 is larger than that of the spring 9. The attractive force of the electromagnet 3 is larger than the tension force of the spring 8 so that the attracted member 4 is held in the attracted position as shown in FIG. 1 when the electromagnet 3 is energized. In the position as shown in FIG. 1 actually, the arm 6*b* of the control lever 6 is further engaged with a holding member (not shown) so that the control lever 6** is firmly held in the position as shown even if an impact is given to the mechanism.

The example as shown in FIGS. 1 and 2 is a shutter control mechanism for controlling the releasing timing of the trailing shutter blind of a focal plane shutter in which the control lever 6 is associated with a trailing shutter blind releasing member (not shown) and releases the trailing shutter blind when the electromagnet 3 is deenergized and the attracted member 4 is separated from the iron core 1. The electromagnetic coil 2 is controlled by a shutter speed control circuit in the camera and is energized to attract the member 4 to the iron core 1 when the trailing shutter blind is to be held in the stand-by position after the leading shutter blind of the focal plane shutter is released.

FIG. 2 shows the state where the attracted member 4 is released from the electromagnet 3 and the lever 6 is in the released position rotated counterclockwise from the position of FIG. 1. When the electromagnetic coil 2 is deenergized, the attracted member 4 is separated from the electromagnet 3 by the tension force of the spring 8 overcoming the tension force of the other spring 9.

In the present invention, the attracted member 4 is mounted on the control lever 6 at the axle 5 thereof with the intervention of a resilient material. The resilient material allows the attracted member 4 to tilt around the axle 5 of the control lever 6 so that the contact face of the attracted member 4 can be put into perfect face contact with the contact face of the iron core 1 of the electromagnet 3 even if the axle 5 of the control lever 6 does not extend in parallel to the contact face of the iron core.

Figure 3:
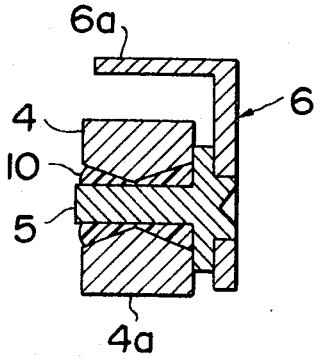
FIG. 3 is an enlarged sectional side view showing the internal structure of an example of an attracted member employed in an embodiment of the present invention.

Referring to the first embodiment shown in FIG. 3, an attracted member 4 is mounted on an axle 5 with the intervention of a resilient material 10 interposed on the axle 5. The attracted member 4 is provided with a through hole, the diameter of which is made smallest at the middle of the hole so that the attracted member 4 is in contact with the axle 5 at the middle of the hole. The axle 5 is secured to the control lever 6. The space between the internal face of the through hole of the attracted member 4 and the outer diameter or periphery of the axle 5 is filled with a resilient material such as a synthetic resin. When the attracted member 4 is moved down to the upper contact face of the iron core 1, the contact face 4*a* of the attracted member 4 is put into perfect face contact with the upper end face of the iron core 1 even if the axle 5 is not in perfectly parallel to the contact face of the iron core and the contact face 4*a* of the attracted member 4 is not in parallel at first with the contact face of the iron core 1. The attracted member 4 is slightly rotatable around the axle 5 with a slip between the through hole of the member 4 and the resilient material 10 and/or between the resilient material 10 and the axle 5, or with a resilient deformation of the resilient material 10.

Figure 4:
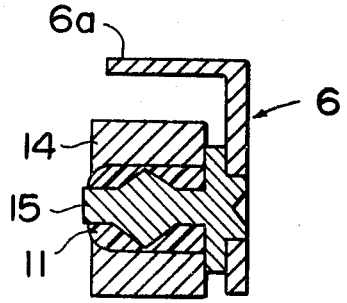
FIG. 4 is an enlarged sectional side view showing the internal structure of another example of an attracted member employed in another embodiment of the present invention.

FIG. 4 shows another embodiment of the present invention in which the axle 15 has a large diameter portion 15*a* and the diameter of the through hole of the attracted member 14 is constant throughout the hole. The operation and result of this embodiment are quite the same as those of the first embodiment as shown in FIG. 1. The resilient material 11 fills the space between the axle 15 and the member 14.

Figure 5:
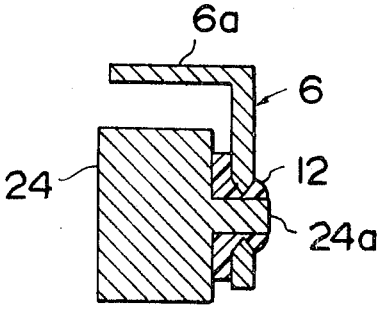
FIG. 5 is an enlarged sectional side view showing the internal structure of still another example of still another embodiment of the present invention.

FIG. 5 shows still another embodiment of the present invention in which the attracted member 24 does not have a through hole but has a projecting axle 24*a* which is engaged with a through hole provided in the control lever 16. There is a resilient material 12 filled between the through hole of the control lever 16 and the axle 24*a* of the attracted member 24. In this embodiment also, the attracted member 24 is tiltable about its axle 24*a* to be put into perfect face contact with the contact face of the iron core (not shown).

In the above described embodiments, the axle and the through hole are partly in direct contact with each other at the middle portion of the through hole. This is made for the purpose of protecting the resilient material from fatigue.

We claim:

1. A magnet control device for use in a camera comprising a magnet means having an attracting face, a member to be attracted by the magnet means having an attracted face to be put into contact with the attracting face of the magnet means, and a control lever carrying said attracted member, said attracted member being mounted around an axle secured to said control lever for rotation thereabout, wherein the improvement comprises a resilient material disposed between said axle and said attracted member for allowing said attracted member to tilt around the axle to follow an inclination of the attracting face, whereby said attracted face is positionable in perfect face contact with said attracting face.

2. A magnet control device as defined in claim 1 wherein said attracted member has a through hole having a diameter larger than the outer diameter of said axle, and said resilient material is provided between the axle and the through hole.

3. A magnet control device as defined in claim 2 wherein said through hole has a portion at which the diameter thereof is reduced to the diameter substantially equal to that of the axle.

4. A magnet control device as defined in claim 2 wherein said axle has a portion at which the diameter thereof is enlarged to the diameter substantially equal to that of the through hole.

* * * * *